US005904606A

United States Patent [19]

Zimmer et al.

[11] Patent Number: 5,904,606

[45] Date of Patent: May 18, 1999

[54] PANEL FOR TOY CONSTRUCTION SYSTEM

[75] Inventors: John Zimmer, Blue Bell; Michael DiLabio, Limerick, both of Pa.

[73] Assignee: Connector Set Limited Partnership, Hatfield, Pa.

[21] Appl. No.: 08/795,012

[22] Filed: Feb. 5, 1997

[51] Int. Cl.[6] ..... A63H 33/04; A63H 33/10

[52] U.S. Cl. ..... 446/108; 446/85; 446/118; 446/124; 52/582.1

[58] Field of Search ..... 446/85, 86, 93, 446/94, 108, 110, 111, 118, 126, 124, 128; 434/72; 52/582.1

[56] References Cited

U.S. PATENT DOCUMENTS

| | | | |
|---|---|---|---|
| 3,594,940 | 7/1971 | Yonezawa | 446/108 |
| 4,129,975 | 12/1978 | Gabriel . | |
| 4,164,091 | 8/1979 | Lin | 446/118 |
| 4,199,894 | 4/1980 | Fischer | 446/91 |
| 4,571,200 | 2/1986 | Serna | 446/85 |
| 5,199,919 | 4/1993 | Glickman . | |

FOREIGN PATENT DOCUMENTS

| | | |
|---|---|---|
| 296 02 205 U1 | 7/1996 | Germany . |

*Primary Examiner*—Robert A. Hafer
*Assistant Examiner*—Laura Fossum
*Attorney, Agent, or Firm*—Schweitzer Cornman Gross & Bondell LLP

[57] ABSTRACT

A panel for housing a photovoltaic cell or the like, for use in combination with a toy construction set of the type having a plurality of connector elements and rod-like struts engageable with the connector elements has a panel body and a plurality of legs extending from the panel body. The legs are adapted for tight frictional engagement with cavities in the connectors and are located such that the connectors mounted thereon can be interconnected to each other using the connectors and struts so that the panel can be incorporated in an assembly comprised of a combination of the connectors and struts. Outside legs are located near the corners of the panel such that one connector can be used to join two adjacent panels. A pair of inside legs are located near the center of the panel for mounting a center connector. The inside and outside legs are oriented such that connectors mounted to the outside legs can be easily interconnected with each other and with the center connector using the connectors and struts of the toy construction set thereby forming a base for the panel.

14 Claims, 6 Drawing Sheets

PANEL FOR TOY CONSTRUCTION SYSTEM

BACKGROUND AND SUMMARY OF THE INVENTION

The present invention is directed to a toy construction system, and in particular a panel which may be incorporated in such a toy construction system.

The panel of the present invention is designed to be used with a toy construction system comprised of a combination of connector elements and structural elements which can be combined in various forms to form composite structures. U.S. Pat. Nos. 5,061,219, 5,137,486 and 5,199,919 to Glickman, the disclosures of which are herein incorporated by reference, disclose such a toy construction system. The toy construction system includes a plurality of hub-like connector elements and rod-like strut elements which can be combined in various forms to create rigid skeletal structures. As will be further described below, the connectors of this system include gripping arms adapted for lateral, snap-in engagement of the struts and include cavities disposed radially around a center hub portion between the hub portion and the gripping arms.

The panel of the present invention is suitable to house a photovoltaic cell or solar panel, or the like, and includes legs which are sized and shaped for a tight frictional engagement with the cavities of the connectors such that the panel can be incorporated in an assembly comprised of the connectors and struts.

The legs are located on the bottom of the panel, one at each corner and two near the center. Connector elements can be mounted on the legs in various combinations to allow the panel to be incorporated in a larger assembly composed of the connectors and struts. The legs located at the four corners of the panel are spaced from the sides thereof a distance such that one connector can be used to engage the legs of two adjacent panels thereby allowing the two panels to be joined together. In addition, the center legs and the corner legs are located such that connectors mounted thereon can be interconnected by a combination of connector elements and strut elements thereby providing a rigid support for the panel.

The known hub-like connector elements have a plurality of generally radially oriented sockets for receiving and lockingly engaging end portions of the struts. Specifically, the connectors include a plurality of spaced-apart gripping arms disposed radially around a center hub portion. The gripping arms define socket-forming recessed adapted for lateral snap-in insertion of the struts. Additionally, the end extremities of the struts are formed with an annular groove, defining a flanged end such that the strut is locked against axial and lateral withdrawal from the connector once installed.

As described in the above-mentioned patents, and specifically U.S. Pat. No. 5,199,919, the connectors are provided in various configurations including a planar "snowflake" configuration having eight sockets disposed radially 360 degrees around, and equidistant from, a center hub portion. Also disclosed is a multiplanar, composite connector formed of two connectors, each including a special recess adapted such that the two connectors can be assembled in a 90 degree relationship to one another.

The panel of the present invention is particularly suitable for motorized structures composed of assemblies of the connectors and strut elements of the toy construction system. The panel can be placed adjacent or mounted on such structures and can provide power to the motorized structure with an enclosed solar cell, or other power source.

BRIEF DESCRIPTION OF THE DRAWINGS

For a more complete understanding of the above and other features and advantages of the invention, reference should be made to the following detailed description of a preferred embodiment of the invention and to the accompanying drawings, wherein.

DESCRIPTION OF THE PREFERRED EMBODIMENTS

Figure 1:
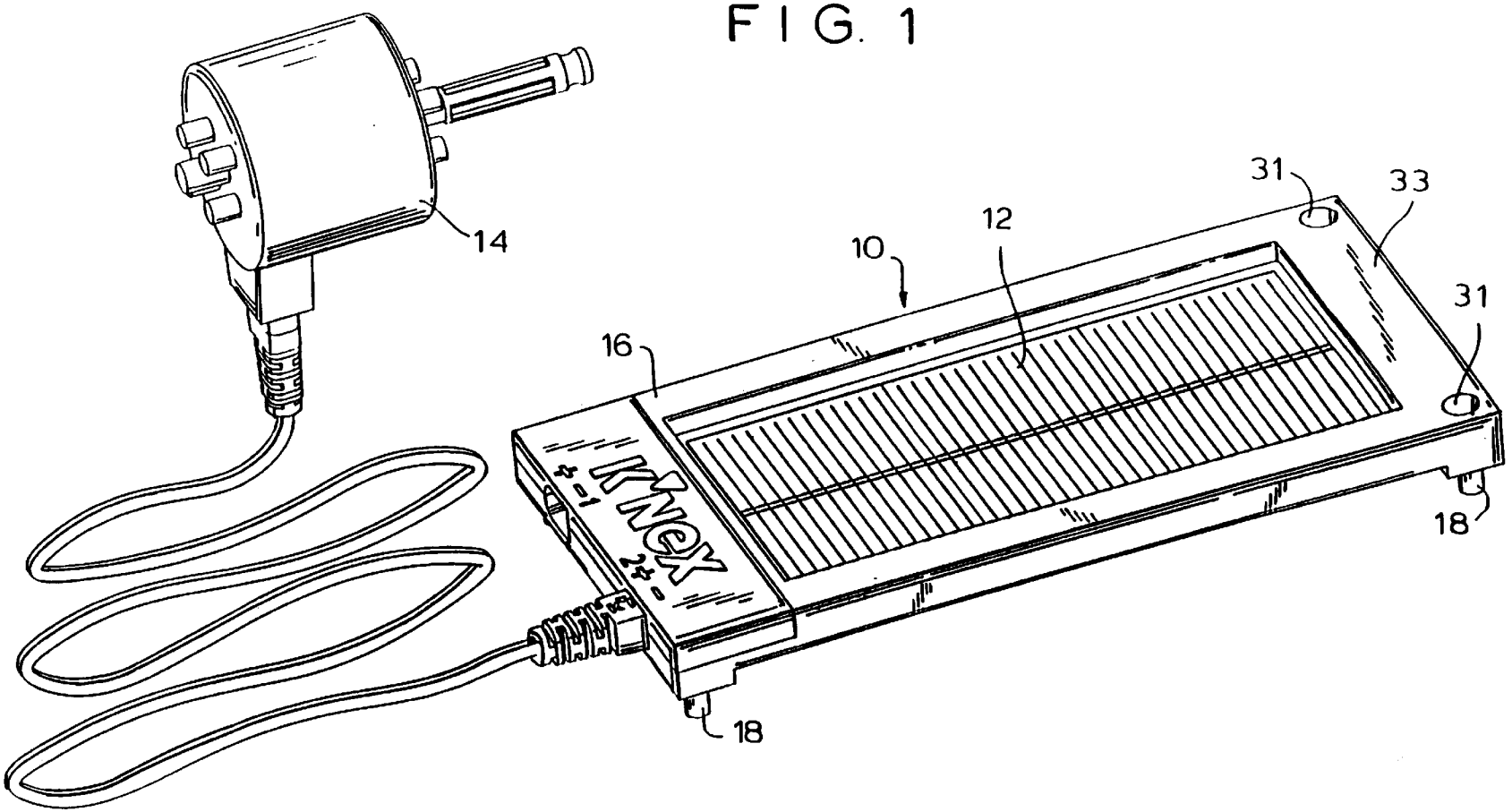
FIG. 1 is a perspective view of the panel, from the top, showing the panel connected to a motor.
Figure 2:
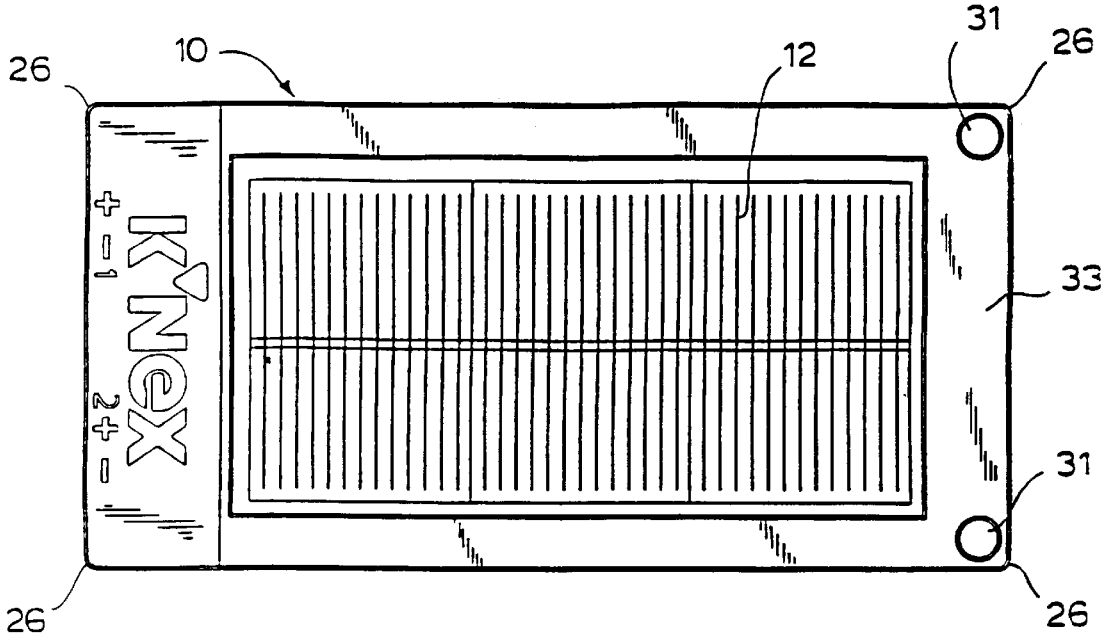
FIG. 2 is a top plan view of the panel of FIG. 1.
Figure 3:
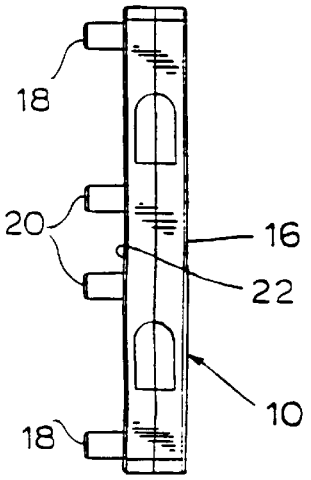
FIG. 3 is a front elevational view of the panel of FIG. 1.
Figure 4:
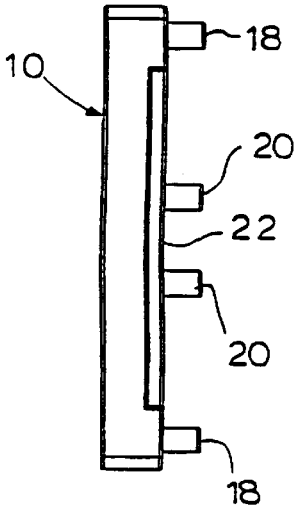
FIG. 4 is a rear elevational view of the panel of FIG. 1.
Figure 5:
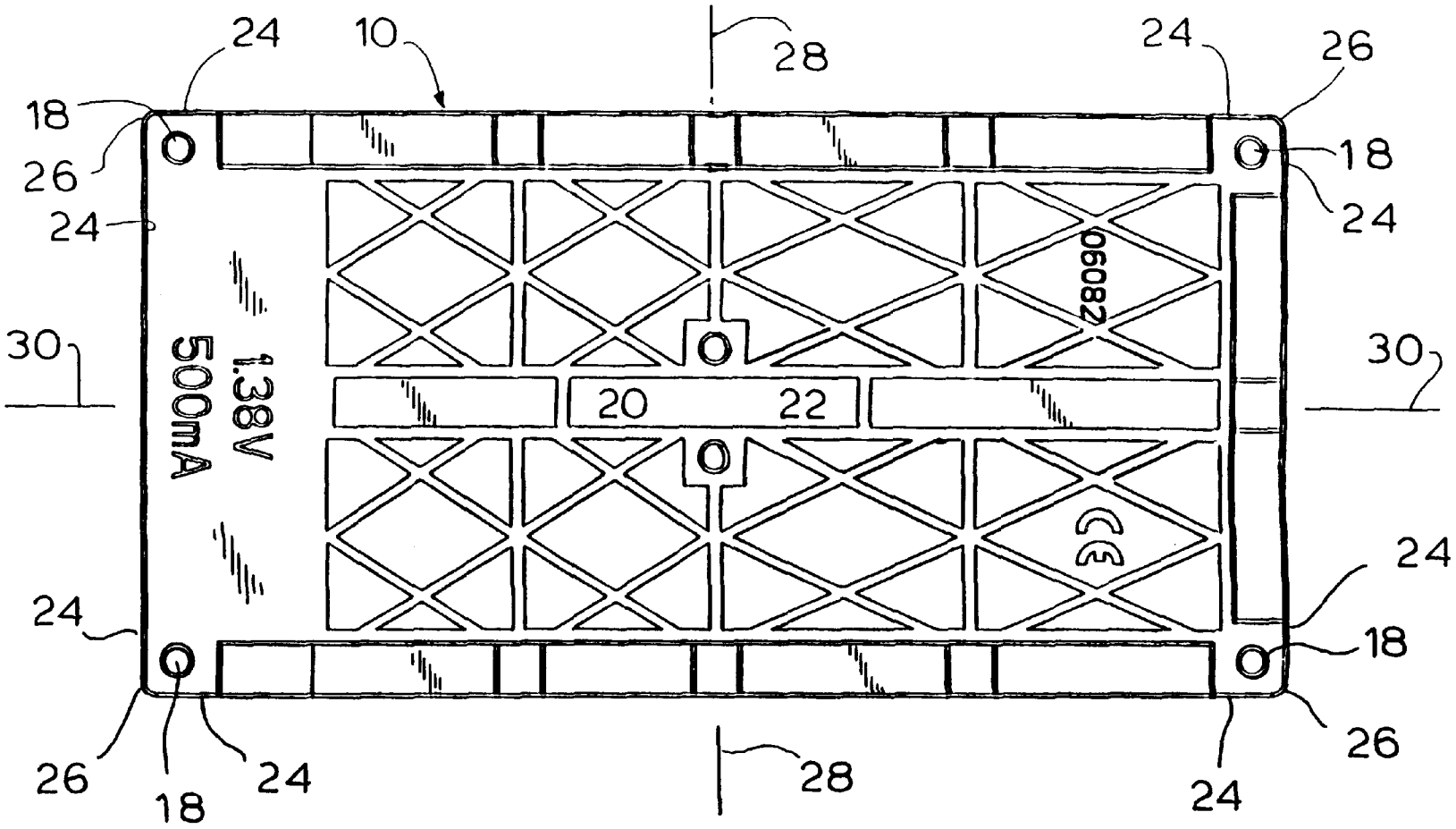
FIG. 5 is a bottom plan view of the panel of FIG. 1.

Referring now to the drawing, and initially to FIG. 1 thereof, the panel 10 of the present invention can house a power source such as a solar cell 12, which can power a motor 14 for use in operating a structure comprised of the connectors and struts of the toy construction set described above. The panel 10 includes a panel body 16 and a plurality of outside legs 18 projecting therefrom.

Referring to FIGS. 2–5, preferably the outside legs 18 are located adjacent the corners 26 of the panel body 16 and a pair of inside legs 20 are located adjacent the center 22 of the panel body 16. Preferably, the inside and outside legs 18, 20 are all of the same length such that the panel 10 can be placed on a supporting surface such as a table or the like.

The outside legs 18 are preferably arranged symmetrically about the center 22 of the panel body 16 and are located substantially equidistant from the sides 24 of the corners 26 of the panel body 16. Preferably, the inside legs 20 are disposed along the lateral center axis 28 of the panel body 16 on opposite sides of the longitudinal center axis 30 and are spaced substantially equidistant from the longitudinal center axis 30.

The panel also preferably includes a pair of tubular recesses 31 located on the top surface 33 of the panel 10. The tubular recesses 31 are preferably sized to frictionally engage a strut element inserted therein such that the strut, once inserted, will remain perpendicular to the top surface 33 of the panel 10. With the insertion of a strut element having a certain length, the proper distance between the solar cell 12 and a light source such as a light bulb can be easily maintained.

Figure 6:
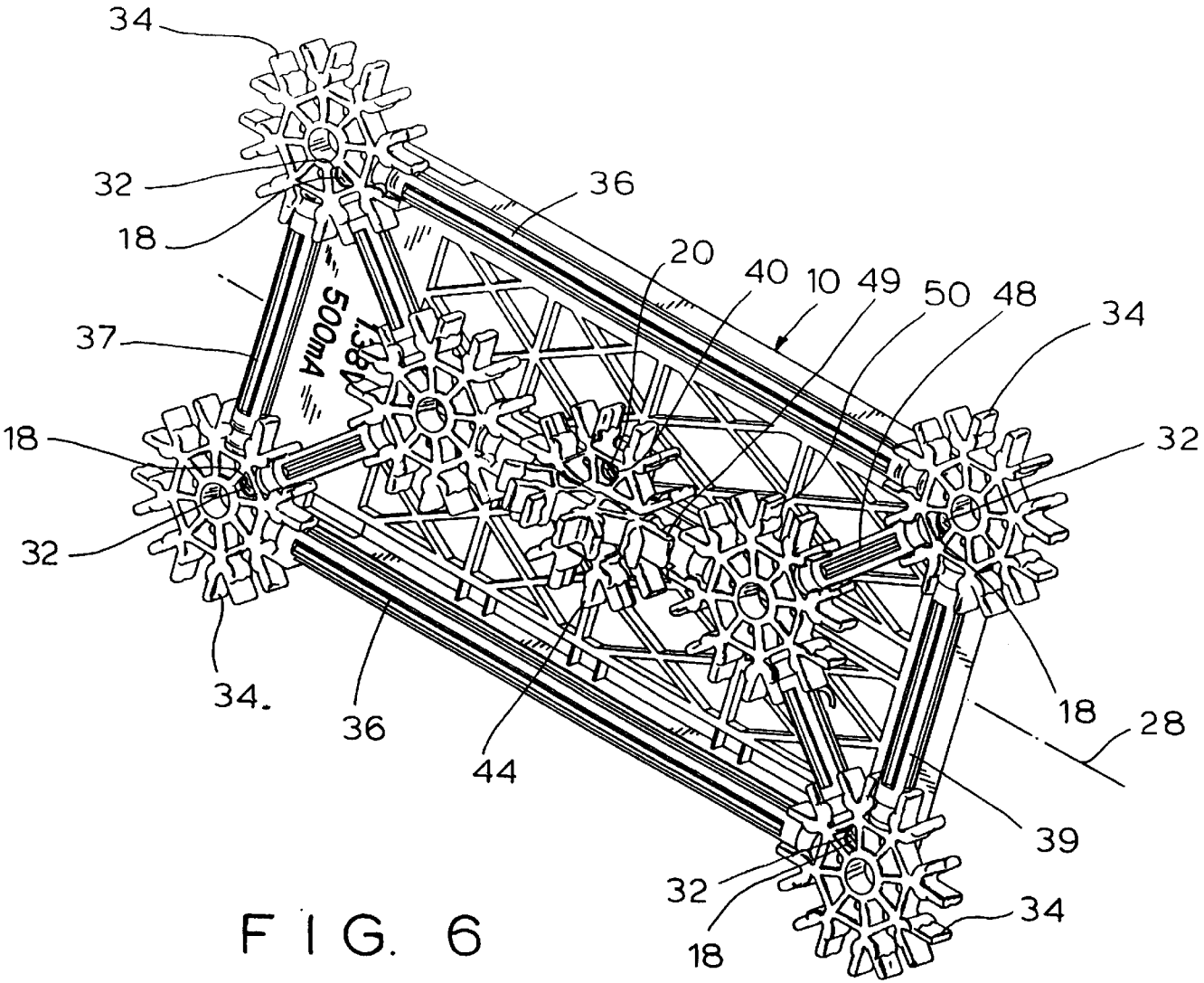
FIG. 6 is a perspective view of an assembly of the panel and a support structure.
Figure 7:
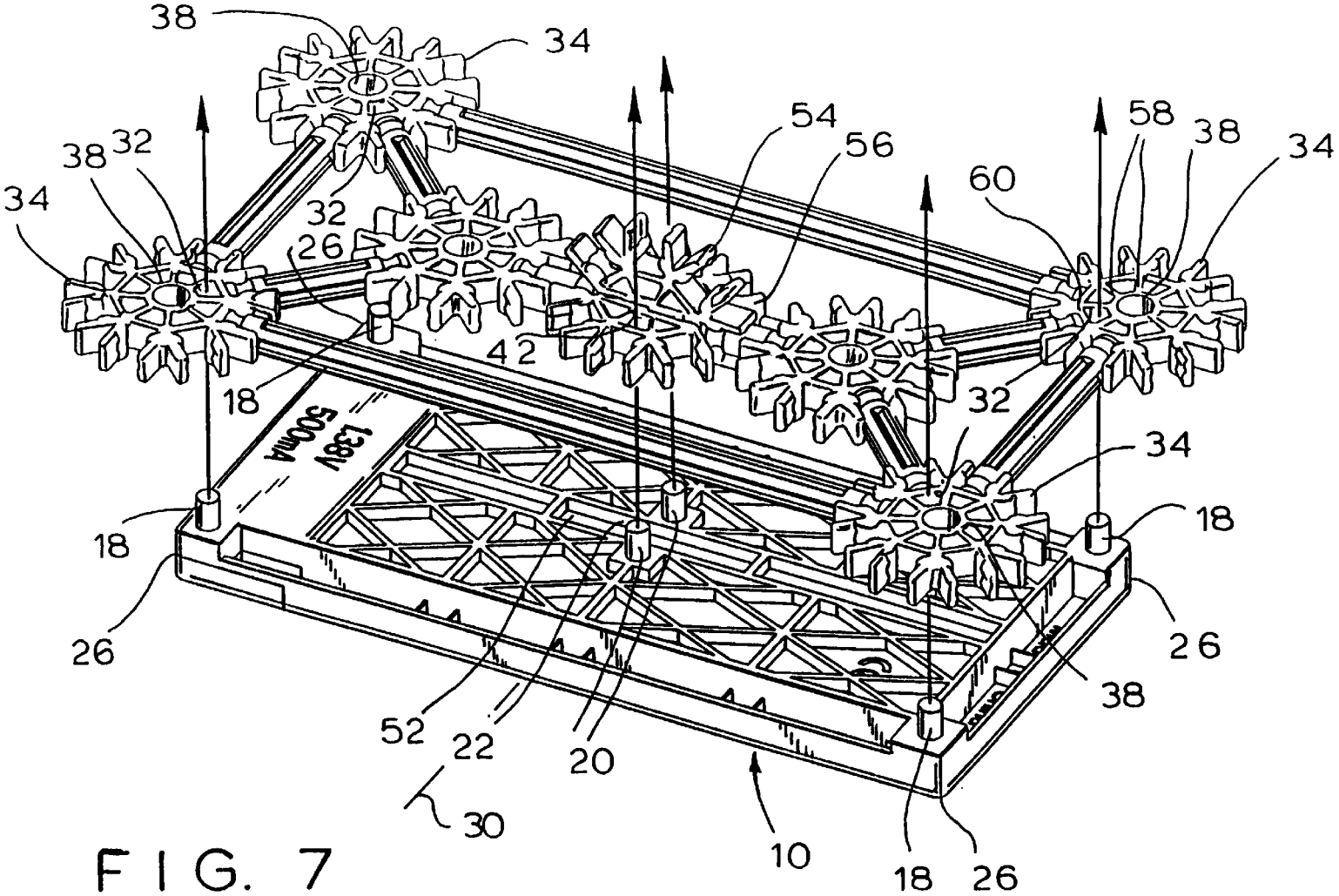
FIG. 7 is a perspective, exploded view of the assembly of FIG. 6.

Referring to FIGS. 6–7, the inside and outside legs 18, 20 are sized and shaped for tight frictional engagement with cavities 32 of the connectors 34 of the toy construction set described above such that the connectors 34 can be securely mounted on the panel 10 for incorporating the panel in a structure formed of an assembly of the connectors 34 and struts 36. The outside legs 18 are preferably located such that when a connector 34 is mounted thereon, the center of a hub portion 38 thereof is aligned adjacent, and preferably directly over, the corner 26 of the panel body 16. As will be described in detail below, this allows multiple panels 10 to be joined together by individual connectors 34.

The inside legs 20 are preferably aligned to engage separate cavities 40, 42 of the center connector 44 such that the orientation of the center connector 44 is fixed relative to the panel body 16. Also, the location of the inside legs 20 with respect to the longitudinal and lateral center axes 28, 30, described above, provide that the center connector 44 will be aligned with the lateral and longitudinal center axes 28, 30 and with the center 22 of the panel body 16.

Furthermore, the inside and outside legs 18, 20 are oriented such that connectors mounted thereon can be interconnected by a combination of connectors 34 and struts 36, 37 as shown, and such that the connectors 34 can be interconnected with the center connector 44 by a combination of struts 48, 49 and connectors 50 thereby providing a stable base or support for the panel 10.

Preferably, the panel body 16 has a width and a length which are substantially equal to integer multiples of a diameter of the connectors 34. In the embodiment depicted, the panel body 16 has a width equal to approximately twice the diameter of a connector 34 and a length equal to approximately four times the diameter of a connector 34. These dimensions, along with the location of the outside legs 18 adjacent the corners 26 of the panel body 16, provide for the interconnectability discussed in the previous paragraph, while allowing two adjacent panels to be connected together with individual connectors 34 at the corners 26 of the panel body 16.

The connector elements have spoke-like radial walls 58 extending outward from the hub portion 38 to the gripping arms. The outward ends of adjacent radial walls 58 are connected by web sections 60, each of which forms an inner wall of one of the socket-forming recesses and forms an outer wall of one of the cavities 32. Thus, the cavities 32 are each bounded by the hub portion 38, a pair of adjacent radial walls 58 and a web section 60.

The strut elements are provided in several, predetermined lengths such that in a system of "n" different lengths, the length of each strut is determined according to the formula:

$$L_x=(1.414)^{(x-1)}*D_{min}-(2*d), \text{ where}$$

$L_x$=the length of the $x^{th}$ strut of a series of 1 to "n", $D_{min}$=the spacing between hub axis of two connector elements joined by the shortest strut element of the series, and d=the distance from the hub axis to the end wall of the socket-forming section.

Figure 8:
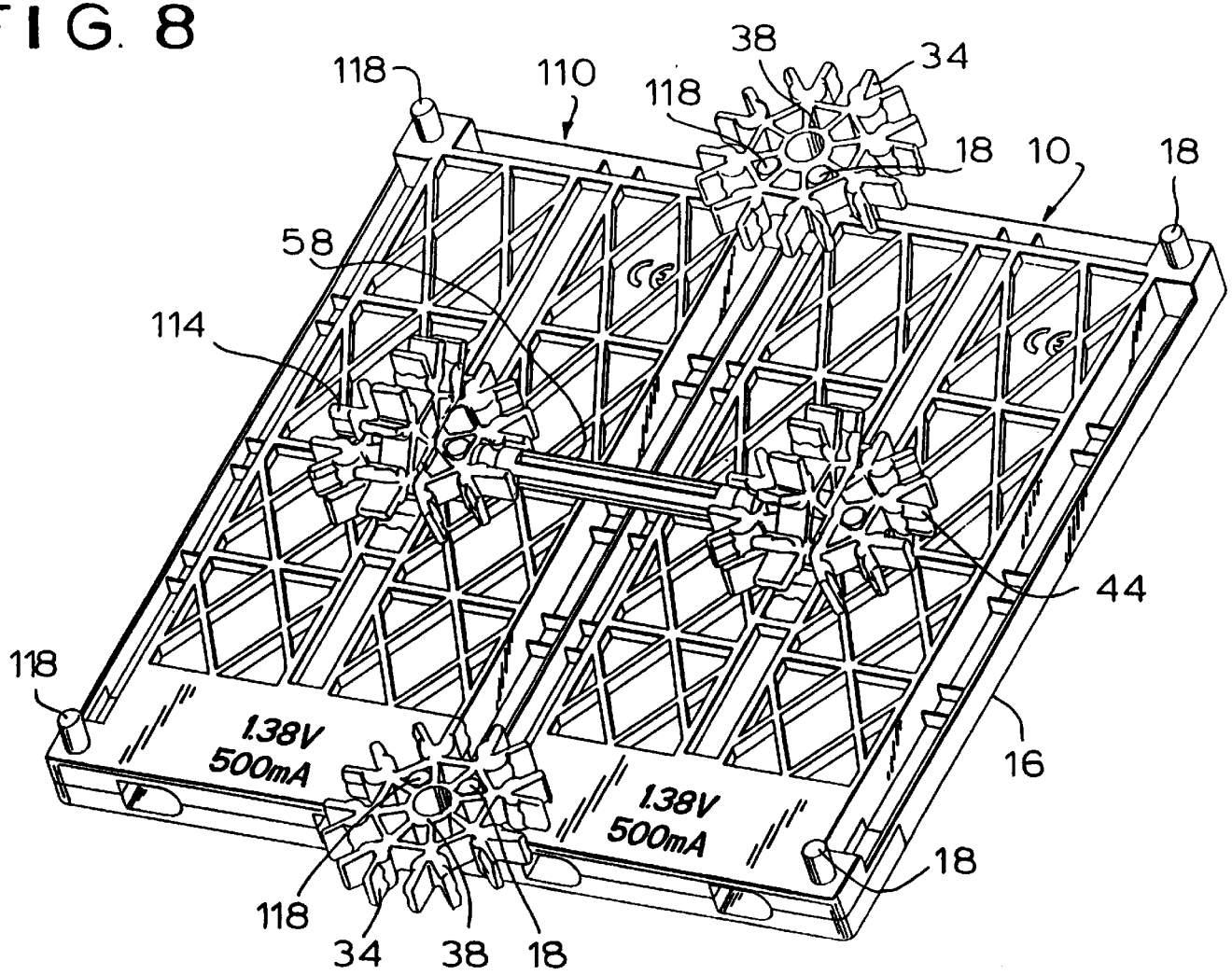
FIG. 8 is a perspective view of an assembly of two panels.

Referring to FIG. 8, two panels 10, 110, can be joined together using connectors 34, 44, 144 and a strut 58. As discussed above, the outside legs 18 are located such that the hub portion 38 of a connector 34 mounted thereon is aligned with the corner 26 (hidden) of the panel body 16. In this orientation, the connector 34 is also aligned to accept an outside leg 118 of the second panel 110 thereby joining the two panels 10, 110 together in a close abutting relationship. The width dimension of the panel body 16 provides that the center connectors 44, 144 can be interconnected with a single strut 58 of the toy construction system. The panels 10, 110 are shown joined in a side-to-side relationship, however it should be appreciated that the configuration and dimensions discussed above also provide that the two panels can be similarly joined in an end-to-end relationship.

Referring again to FIG. 7, the panel body 16 includes a recess 52 intermediate the two inside legs 20 which allows a multiplanar, composite connector, such as the center connector 44 depicted, to mount on the panel body 16 in such a manner that it is substantially planar with the connectors 34 mounted on the outside legs 18. Such a recess 52 is beneficial because the multiplanar connector 44 is comprised of two portions, one of which extends a short distance below the other. Specifically, a first part 54 extends outwardly, perpendicular to the panel body 16 and includes a portion which extends below a second part 56. In order for the second part 56 to lie in the same plane as the connectors 34 mounted on the outside legs 18, the bottom of the recess 52 should be below the respective bases of the outside legs 18, i.e. below where the outside legs 18 meet the panel body 16. The dimensions of the recess can vary, however the inside legs 20 are preferably spaced from the recess 52 such that the bases thereof lie in substantially the same plane as the bases of the outside legs thereby providing a stable, aligned abutting surface for the connector 44.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A panel in combination with a toy construction set, comprising:

(a) a plurality of connectors and rod-like struts, said rod-like struts having a plurality of lengths and being engageable with said connectors to form a coherent structure;

(b) said connectors having a hub portion with a plurality of pairs of spaced-apart gripping arms disposed radially therearound defining socket-forming recesses sized and shaped for lateral snap-in engagement of said struts, and having cavities disposed radially around said hub portion between said hub portion and said socket-forming recesses;

(c) a panel body having a plurality of rod-like legs extending therefrom, said legs being sized and shaped for tight frictional engagement with said cavities of said connectors; and (d) said legs being located such that when two of said connectors are mounted on two separate ones of said legs by inserting said two leas within cavities of said two connectors, said two connectors are interconnectable with one of said rod-like struts;

(e) whereby said panel structure can be incorporated in combination with a structure formed of an assembly of said connectors and struts.

2. A panel as in claim 1, wherein said panel body comprises an outside leg disposed adjacent a periphery of said panel body and spaced from said periphery a distance such that, when one of said connectors is mounted on said outside leg, a center of a hub portion thereof lies adjacent said periphery.

3. A panel as in claim 2, wherein said panel body comprises four corners and four outside legs, each outside leg being disposed adjacent one of said corners substantially equidistant from two sides of said corner such that, when a connector is mounted on one of said outside legs, a center of a hub portion thereof lies adjacent said corner.

4. A panel as in claim 3, wherein said four outside legs are arranged substantially symmetrically about a center axis of said panel body.

5. A panel as in claim 2, wherein:

(a) said panel body comprises two inside legs adapted to engage separate cavities of one of said connectors; and (b) said inside and outside legs being located such that a connector mounted on said outside leg is connectable to a connector mounted on said two inside legs by a combination of said connectors and struts.

6. A panel as in claim 5, wherein said two inside legs are disposed adjacent a center of said panel body such that, when a connector is mounted on said inside legs, a center of a hub portion thereof lies on said center of said panel body.

7. A panel as in claim 6, wherein:

(a) said connectors have two cavities spaced substantially equidistant from opposed sides of said hub portion thereof and aligned with an axis of an opposed pair of socket-forming recesses;

(b) said two inside legs of said panel body are disposed along a first center axis of said panel body an opposed sides of a second center axis thereof; and (d) said inside legs being substantially equidistant from said second center axis such that, when mounted on said two inside legs, said connector is aligned with said center of said panel body and with said first and second center axes thereof.

8. A panel as in claim 7, wherein said panel body comprises four corners and four outside legs, each outside leg being disposed adjacent one of said corners substantially equidistant from two sides of said corner such that, when a connector is mounted on one of said outside legs, a center of a hub portion of said connector lies adjacent said corner.

9. A panel as in claim 8, wherein said inside and outside legs are located such that a plurality of connectors can be mounted on said panel, said connectors being connectable to each other by a combination of said connectors and said struts.

10. A panel as in claim 9, wherein said two inside legs are disposed along a lateral center axis of said panel body.

11. A panel as in claim 9, wherein said panel body has a length and a width each substantially equal to integer multiples of a diameter of one of said connectors.

12. A panel as in claim 11, wherein said panel body has a width substantially equal to twice said diameter and a length substantially equal to four times said diameter.

13. A panel as in claim 2, wherein said panel body has a length and a width each substantially equal to integer multiples of a diameter of one of said connectors.

14. A panel as in claim 13, wherein said panel body has a width substantially equal to twice said diameter and a length substantially equal to four times said diameter.

* * * * *